US006303558B1

(12) United States Patent
Emery et al.

(10) Patent No.: US 6,303,558 B1
(45) Date of Patent: Oct. 16, 2001

(54) DETERGENT COMPOSITION CONTAINING AT LEAST TWO GRANULAR COMPONENTS

(75) Inventors: William Derek Emery; Pauline Farnworth; Georgina Hawkes; Terry Instone, all of Bebington (GB); Seeng Djiang Liem, Vlaardingen (NL); John Lloyd, Bebington (GB); Gilbert Martin Verschelling, Vlaardingen (NL)

(73) Assignee: Lever Brothers Co., division of Conopco, New York, NY (US)

( * ) Notice: Subject to any disclaimer, the term of this patent is extended or adjusted under 35 U.S.C. 154(b) by 0 days.

(21) Appl. No.: 09/084,569

(22) Filed: May 26, 1998

(30) Foreign Application Priority Data

May 30, 1997 (GB) ..... 9711356

(51) Int. Cl.[7] ..... C11D 17/00

(52) U.S. Cl. ..... 510/424; 510/427; 510/446; 510/452

(58) Field of Search ..... 510/349, 351, 510/352, 377, 446, 452, 421, 422, 424, 427

(56) References Cited

U.S. PATENT DOCUMENTS

| | | | | |
|---|---|---|---|---|
| 3,769,222 | | 10/1973 | Yurko et al. | 252/89 |
| 3,849,327 | * | 11/1974 | Disalvo et al. | 252/109 |
| 3,915,878 | | 10/1975 | Yurko et al. | 252/89 |
| 3,920,586 | | 11/1975 | Bonaparte et al. | 252/531 |
| 4,639,326 | * | 1/1987 | Czempik et al. | 252/91 |
| 4,828,721 | | 5/1989 | Bollier | 252/8.7 |
| 4,923,628 | | 5/1990 | Appel et al. | 252/135 |
| 5,009,804 | * | 4/1991 | Clayton et al. | 252/90 |
| 5,496,495 | * | 3/1996 | Beck et al. | 252/174.23 |
| 5,569,645 | | 10/1996 | Dinniwell et al. | 510/276 |
| 5,576,277 | * | 11/1996 | MacBeath et al. | 510/113 |
| 5,919,747 | * | 7/1999 | Kazuta et al. | 510/444 |

FOREIGN PATENT DOCUMENTS

| | | |
|---|---|---|
| 1070210 | 1/1980 | (CA) . |
| 2 050 560 | 4/1971 | (DE) . |
| 42 16 775 | 11/1993 | (DE) . |

(List continued on next page.)

OTHER PUBLICATIONS

Derwent abstract of JP 8027498, Jun. 1989.
Derwent abstract of JP 2726898, May 1988.
Derwent abstract of JP 7197084, Nov. 1991.
Great Britain Search Report in the application of G.B. 9711356 dated Aug. 29, 1997.
Derwent abstract JP 6179892, Jul. 1996.
Derwent abstract of DE 3131668 with Miyazaki et al., U.S. 4,405,484, Sep. 1983.
Derwent abstract of PCT patent application WO 96/23864, Mar. 1992.
Derwent abstract of European patent application EP 219 328, Apr. 1987.
Derwent abstract of European patent application EP 168 102, Jun. 1997.
Derwent abstract of German patent application DE 4229660, Oct. 1984.
Derwent abstract of German patent application DE 3545947, Dec. 1987.
Derwent abstract of German patent application DE 3424299, Apr. 1988.
Derwent abstract of German patent application DE 19601841, Feb. 1999.
Derwent abstract of Japanese patent application JP 4363400, Mar. 1988.
Derwent abstract of Japanese patent application JP 7011293, Feb. 1997.
Derwent abstract of Japanese patent application JP 7286195, May 1996.
Derwent abstract of Japanese patent application JP 7286196, Aug. 1998.
Derwent abstract of Japaanese patent application JP 7286197, Jun. 1998.
Derwent abstract of Japanese patent application JP 7286198, Jan. 1998.
Derwent abstract of Japanese patent application JP 7258693, Jun. 1993.
Derwent abstract of Japanese patent application JP 7268397, Aug. 1997.
Derwent abstract of Japanese patent application JP 7268399, Aug. 1999.
Derwent abstract of Japanese patent application JP 7268400, Aug. 1992.
Derwent abstract of Japanese patent application JP 8003600, Jun. 1997.
International Search Report in the application of PCT/EP 98/02982.
Derwent abstract of JP 09 095694, May 1994.
Derwent abstract of JP 03084100, Aug. 1996.
Derwent abstract of JP 08027498, Jul. 1998.
PCT application in a PCT International Search Report, PCT/EP 99/08895, Aug. 1995.
PCT application in a PCT International Search Report, PCT/EP 99/08896, Jun. 1996.

*Primary Examiner*—Necholus Ogden
(74) *Attorney, Agent, or Firm*—Rimma Mitelman

(57) ABSTRACT

A particulate detergent composition or component of high bulk density (at least 600 g/l), comprising at least 10% by weight of detergent surfactant and from 10 to 70% by weight of detergency builder, is composed of at least two, and preferably at least three, different granular components:

(i) granules comprising at least 60% by weight of anionic surfactant, (ii) granules comprising at least 20% by weight of non-ionic surfactant, and less than 10% by weight of aluminosilicate.

(iii)optionally, granules comprising detergency builder.

17 Claims, No Drawings

FOREIGN PATENT DOCUMENTS

| | | | |
|---|---|---|---|
| 42 29 660 | | 3/1994 | (DE) . |
| 195 24 722 | | 1/1997 | (DE) . |
| 164 514 | | 12/1985 | (EP) . |
| 168 102 | | 1/1986 | (EP) . |
| 220 024 | | 4/1987 | (EP) . |
| 221 776 | | 5/1987 | (EP) . |
| 242 138 | | 10/1987 | (EP) . |
| 266 863 | | 5/1988 | (EP) . |
| 289 311 | | 11/1988 | (EP) . |
| 289 312 | | 11/1988 | (EP) . |
| 289 313 | | 11/1988 | (EP) . |
| 341 072 | | 11/1989 | (EP) . |
| 342 043 | | 11/1989 | (EP) . |
| 351 937 | | 1/1990 | (EP) . |
| 228 011 | | 4/1990 | (EP) . |
| 367 339 | | 5/1990 | (EP) . |
| 384 070 | | 8/1990 | (EP) . |
| 390 251 | | 10/1990 | (EP) . |
| 390 287 | | 10/1990 | (EP) . |
| 420 317 | | 4/1991 | (EP) . |
| 425 277 | | 5/1991 | (EP) . |
| 430 328 | | 6/1991 | (EP) . |
| 437 950 A2 | | 7/1991 | (EP) . |
| 437 950 A3 | | 7/1991 | (EP) . |
| 451 894 | | 10/1991 | (EP) . |
| 470 250 | | 2/1992 | (EP) . |
| 477 974 | | 4/1992 | (EP) . |
| 534 525 | | 9/1992 | (EP) . |
| 521 635 | | 1/1993 | (EP) . |
| 550 086 | | 7/1993 | (EP) . |
| 560 395 | | 9/1993 | (EP) . |
| 562 628 | | 9/1993 | (EP) . |
| 593 014 | | 4/1994 | (EP) . |
| 0643130 | * | 4/1994 | (EP) . |
| 618 290 | | 5/1994 | (EP) . |
| 639 637 | | 2/1995 | (EP) . |
| 639 639 | | 2/1995 | (EP) . |
| 643 130 | | 3/1995 | (EP) . |
| 653 481 | | 5/1995 | (EP) . |
| 0 688 861 | | 12/1995 | (EP) . |
| 2 356 718 | | 1/1978 | (FR) . |
| 1303479 | | 1/1973 | (GB) . |
| 1 470 250 | | 4/1977 | (GB) . |
| 1 473 202 | | 5/1977 | (GB) . |
| 2 123 044 | | 1/1984 | (GB) . |
| 2 301 835 | | 12/1996 | (GB) . |
| 2 304 726 | | 3/1997 | (GB) . |
| 08 027498 | | 1/1996 | (JP) . |
| 92/07060 | | 4/1992 | (WO) . |
| 93/02168 | | 2/1993 | (WO) . |
| 93/18124 | | 9/1993 | (WO) . |
| 93/20172 | | 10/1993 | (WO) . |
| 94/01521 | | 1/1994 | (WO) . |
| 95/02682 | | 1/1995 | (WO) . |
| 96/34084 | | 10/1995 | (WO) . |
| 96/06916 | | 3/1996 | (WO) . |
| 96/06917 | | 3/1996 | (WO) . |
| 96/10070 | | 4/1996 | (WO) . |
| 96/22355 | | 7/1996 | (WO) . |
| 96/38529 | | 12/1996 | (WO) . |
| 96/38530 | | 12/1996 | (WO) . |
| 97/00590 | | 1/1997 | (WO) . |
| 97/00591 | | 1/1997 | (WO) . |
| 97/32002 | | 9/1997 | (WO) . |
| 97/32005 | | 9/1997 | (WO) . |
| 97/33957 | | 9/1997 | (WO) . |
| 98/54278 | | 12/1998 | (WO) . |

* cited by examiner

DETERGENT COMPOSITION CONTAINING AT LEAST TWO GRANULAR COMPONENTS

TECHNICAL FIELD

The present invention relates to a medium to high bulk density particulate detergent composition.

BACKGROUND

Traditionally, particulate detergent compositions have been manufactured by the spray drying process, in which a slurry of components such as anionic detergent active, builder material and optionally non-anionic detergent active is manufactured and then dried by atomising it and spraying it into a stream of air at high temperature. The spray-dried compositions are found in practice to have bulk densities less than 600 g/l. There are limits on the quantity of anionic detergent active that can be included due to the need to form a slurry before spray-drying. The resultant spray-dried granules may be used directly as a detergent composition or other components may be post-dosed, for example heat or moisture sensitive components, to provide a complete powder composition.

In recent years, a number of detergent powder manufacturing processes have been developed in which a spray-drying tower is not used. Such so called non-tower route (NTR) processes typically involve granulation of anionic detergent active and builder in a high or medium speed mixer/densifier, typically in the presence of a liquid binder such as water or non-anionic detergent active. High detergent active compositions having medium to high bulk densities (500–900 g/l) have been produced by such non-tower processes.

However, it has been found that such so called concentrated products may have unsatisfactory dispensing properties in wash water, particularly in automatic washing machines. Problems have been encountered such as poor dispersion of the powder into the wash water in the dispenser drawer of a washing machine. A gritty, viscous mass may remain in the dispenser drawer. Further, powder compositions entrained in the wash water may not break up and disperse adequately. Undissolved particles of powder compositions may remain in the wash water. These can adhere to clothes and cause local damage. For example, where the detergent composition contains bleach, an undissolved mass of composition can adhere to clothing and, due to the locally high concentration of bleach, damage the clothing. Undissolved powder composition can remain on the clothes after washing.

SUMMARY OF THE INVENTION

It is an object of the present invention to provide a detergent powder composition having a medium to high bulk density (a bulk density of at least 600 g/l) and a moderate to high anionic detergent active content.

The present inventors have discovered that the dispersion problems of particulate detergent compositions can be due to unfavourable properties of some of the components, such as anionic surfactant, or due to unfavourable interactions between different components which occur in the particles. The inventors have discovered that it is beneficial to concentrate the components having undesirable properties into a smaller number of particles. This entails providing particles of high concentration of the component which has the undesirable property. Further, it is desired to separate components which would show unfavourable interactions if they were included in the same particle.

Accordingly, the present invention provides a particulate detergent composition or component having a bulk density of at least 600 g/l and comprising at least 10% by weight (preferably at least 12% by weight) of organic detergent surfactant and from 10 to 70% by weight (preferably from 15 to 70% by weight) of detergency builder, the detergent composition or component being composed of at least two, and preferably at least three, granular components:

(i) granules comprising at least 60% by weight of anionic surfactant ("anionic surfactant granules"), (ii) granules comprising at least 20% by weight of nonionic surfactant and less than 10% by weight aluminosilicate ("nonionic surfactant granules"), and (iii) optionally, granules comprising up to 100% (preferably up to 90%) by weight of detergency builder and optionally from 0 to 10% of nonionic or anionic surfactant("builder granules").

The anionic surfactant granules (i) are preferably present in an amount of from 1 to 70% by weight.

The nonionic surfactant granules (ii) are preferably present in an amount of from 1 to 30% by weight of the composition, more preferably from 1 to 50% by weight.

The optional builder granules are preferably present in an amount of from 5 to 80% by weight, and more preferably in an amount of at least 15% by weight.

The composition limits on the individual granules according to the invention have been found to provide detergent compositions having surprisingly reduced problems of residues in the wash.

It has been found that there is a particularly disadvantageous interaction between nonionic surfactant and aluminosilicate builder, which leads to problems of residues in the wash discussed above. The composition of the present invention allows this problem to be overcome. Further, there can be problems due to unfavourable interaction between aluminosilicate builder and anionic surfactant. The effects of concentrating anionic surfactant in the anionic surfactant granule will be discussed further below.

The total quantity of detergent surfactant in the compositions of the invention is preferably at least 12% by weight, and the quantity of nonionic surfactant is preferably from 1 to 40% by weight, more preferably from 1 to 30% by weight.

The Anionic Surfactant Granules (i)

The anionic surfactant granules preferably comprise from 60 to 90% by weight of anionic surfactant.

The anionic surfactant granules may also contain nonionic surfactant. The anionic surfactant granules may also contain minor ingredients such as water, sodium carboxymethylcellulose, fluorescers, dyes, etc.

The anionic surfactant granules may optionally comprise from 0 to 40% by weight of detergency builder. The builder material may comprise soluble builder such as salts (preferably alkali metal salts, particularly preferably sodium salts) of tripolyphosphate, carbonate, silicate, sesquicarbonate, citrate or mixtures thereof, or burkeite (a double salt of sodium sulphate and sodium carbonate), NTA, polycarboxylic acid monomer, polycarboxylic acid polymer, polycarboxylic acid/maleic acid copolymer or mixtures thereof.

The builder may comprise insoluble builder such as aluminosilicate. The aluminosilicate may comprise zeolite, in particular zeolite MAP, zeolite 4A, amorphous aluminosilicate and mixtures thereof. It is particularly preferred, however, that the quantity of aluminosilicate builder is low. Preferably, aluminosilicate builder provides less than 15% by weight of the anionic surfactant particles, more preferably less than 10%.

The anionic surfactant granules may be manufactured by any suitable process. Preferably, such granules are manufactured by mixing the components in a high speed mixer to agglomerate the components. Suitable mixers will be discussed further below.

Processes for producing granules containing high quantities of anionic surfactant are set out in WO 96/06916A and WO 96/06917A (Unilever).

The method of WO 97/32002A (Unilever) is particularly preferred. In this method, a paste material comprising water and an anionic surfactant, or a mixture of acid surfactant precursor and alkaline neutralising agent, is fed into a drying zone, the paste material being heated in the drying zone to reduce the water content thereof and the paste material being subsequently cooled in a cooling zone to form detergent particles, a layering agent being introduced into the cooling zone during the cooling step. Alternatively, a paste material comprising water and an anionic surfactant, or a mixture of acid surfactant precursor and alkaline neutralising agent fed into a drying zone, the material being heated in the drying zone to reduce the water content thereof and the material being subsequently cooled in a cooling zone to form detergent particles, the material being treated in the cooling zone with a stream of cooling gas. This process can provide detergent particles comprising at least 60% by weight of the particle of an anionic surfactant and not more than 5% by weight of the particle of water. The particles are coated with layering agent.

The detergent particles may comprise anionic surfactant in an amount of at least 60% by weight of the particle, the particles being coated with layering agent and having a porosity of from 0 to 25% by volume of the particle and a particle size distribution such that at least 80% of the particles have a particle size of 180–1500 microns. The layering agent may comprise an aluminosilicate, a silica or a mixture thereof. The layering agent may be dosed into the cooling zone at a weight ratio of from 1:5 to 1:20 relative to the finished particles. The anionic surfactant may be formed in situ by neutralisation of a free acid with neutralising agents such as sodium hydroxide solution or sodium carbonate.

The Nonionic Surfactant Granules (ii)

The nonionic surfactant granules comprise at least 20% by weight of nonionic surfactant.

The quantity of aluminosilicate builder must be less than 10% by weight. This helps to avoid unfavourable generation of residues and poor dispersing properties in wash water.

The nonionic surfactant particles preferably contain less than 10% by weight of anionic surfactant, and preferably substantially no anionic surfactant.

Nonionic surfactant particles for use in the present invention generally fall into one of two classes.

The first class comprises nonionic surfactant carried on water-soluble carrier material. Suitable carrier materials include burkeite, sodium sesquicarbonate, sodium carbonate, sodium sulphate and mixtures thereof. A nonionic surfactant granule comprising water-soluble carrier preferably comprises from 20 to 50% by weight, preferably from 25 to 40% by weight, of nonionic surfactant.

The water-soluble carrier material is preferably present at a level exceeding 40% by weight, preferably 60% by weight or more.

The second class of nonionic surfactant granule comprises water-insoluble carrier material. The insoluble carrier material may comprise silica or aluminosilicate, such as zeolite. However, it is essential that the quantity of aluminosilicate is less than 10% by weight. Where an insoluble carrier material is used, the quantity of nonionic surfactant may exceed 55% by weight of the granule.

Structuring agents such as polyethylene/poly-propylene glycol of average molecular weight in the region 4000–12000, sodium soap, polyvinyl alcohol of average molecular weight in the range 30 000–200 000, alkaline metal succinate etc. may be present. The preferred quantity of structuring agent is in the region of from 0.5 to 10% by weight.

Nonionic-surfactant-containing granules comprising 55% by weight or more of nonionic surfactant, at least 5% by weight of silica of oil absorption capacity of 1.0 ml/g and less than 10% by weight of aluminosilicate are disclosed in our copending application of even date (reference C3777) entitled "Detergent Compositions Containing Nonionic Surfactant Granule". These granules can be manufactured by mixing together components in a granulator (for example an Eirich RVO2 Granulator). Alternatively, 70 to 100% by weight of the solid components and 70 to 95% by weight of the nonionic surfactant can be mixed together in a first step, the remainder of the solid components and nonionic surfactant being added in a second step, preferably under moderate shear. In the second process, the majority of the structurant is preferably added in the second step.

As indicated previously, the nonionic surfactant granules are preferably present in an amount of from 1 to 50%, preferably from 1 to 30%, by weight of the composition. They may suitably provide 20% or more of the composition.

Optional Builder Granules (iii)

The optional builder granule may contain soluble builder such as sodium tripolyphosphate, sodium carbonate, sodium silicate, NTA, sodium sesquicarbonate, burkeite, sodium citrate, polycarboxylic acid monomer, polycarboxylic acid polymer/copolymer or mixtures thereof.

The optional builder granule may also comprise aluminosilicate, preferably crystalline aluminosilicate such as zeolite. The builder granule is preferably present in an amount of from 5 to 80% by weight, and may suitably represent 15% by weight or more of the composition, more preferably 18% by weight or more.

The builder granule optionally contains additional nonionic and/or anionic surfactant selected from the examples above. The total quantity of surfactant in the builder granule is preferably less than 10% by weight.

The builder granule may also comprise layered silicate, available, for example, as SKS-6 (Hoechst).

Any suitable means may be used to prepare the builder granules. For example, the builder granules may be manufactured by spray drying a slurry of the components. Alternatively, the components may be placed in a high speed mixer/densifier and granulated in the presence of liquid binder such as water or solution of polymer, such as builder polymer, or solution of salt, such as silicate.

Other Ingredients

The detergent composition of the present invention may consist only of the anionic granule, the nonionic granule and, optionally, the builder granule.

However, other detergent ingredients may be postdosed to the composition to provide detergent benefits, in which case the composition of the invention may be regarded as a "detergent component" rather than a full "detergent composition".

Examples of ingredients which may be postdosed are bleach ingredients, bleach precursor, bleach catalyst, bleach stabiliser, photobleaches, alkali metal carbonate, water-soluble crystalline or amorphous alkaline metal silicate, layered silicates, anti-redeposition agents, soil release polymers, dye transfer inhibitors, fluorescers, inorganic salts, foam control agents, foam boosters, proteolytic, lipolytic, amylitic and cellulyic enzymes, dyes, speckles, perfume, fabric conditioning compounds and mixtures thereof.

Preferably the detergent composition contains 40 to 85% by weight, in total, of the anionic surfactant granules, the nonionic surfactant granules and, if present, the builder granules.

In each case, there may be more than one type of anionic surfactant granule, nonionic surfactant granule and builder granule.

In the present specification, the term "granule" is used to denote a solid particle of size greater than 200 micrometers. Preferably, such granules will be the direct product of a spray drying or agglomeration process.

Preparation of the Compositions of the Invention

The invention further provides a method of manufacturing a detergent powder composition or component as previously defined, comprising the steps of:

(i) manufacturing granules comprising at least 60% by weight of anionic surfactant, (ii) manufacturing granules containing at least 20% by weight nonionic surfactant and less than 10% by weight aluminosilicate, (iii) optionally manufacturing granules comprising up to 100% by weight of builder and optionally from 0 to 10% by weight of nonionic or anionic surfactant, and mixing the granules produced in steps (i) and (ii), and optionally the granules produced in step (iii).

Detergent Ingredients

The detergent compositions of the invention will contain, as essential ingredients, one or more detergent active compounds (surfactants) which may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid estersulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglyco-sides, glycerol monoethers, and polyhydroxyamides (glucamide).

In the compositions of the invention, the total quantity of detergent surfactant in the composition is at least 10% by weight, preferably at least 12% by weight, more preferably at least 15% by weight. The composition may comprise up to 60% by weight of detergent surfactant, preferably up to 50% by weight.

Preferably, the quantity of anionic surfactant is in the range of from 5 to 50% by weight of the total composition. More preferably, the quantity of anionic surfactant is in the range of from 8 to 35% by weight.

Preferably, the quantity of nonionic surfactant is in the range of from 5 to 20% by weight, more preferably from 5 to 15% by weight.

Detergent compositions suitable for use in most automatic fabric washing machines generally contain anionic non-soap surfactant, or nonionic surfactant, or combinations of the two in any ratio, optionally together with soap.

The anionic surfactant may be produced by neutralising a liquid acid precursor with alkali, such as sodium hydroxide solution or solid sodium carbonate in situ in the granulation process.

The liquid acid precursor of an anionic surfactant may be selected from the acid precursors of linear alkyl benzene sulphonate, alpha-olefin sulphonate, internal olefin sulphonate, alkyl ether sulphate or fatty acid ether sulphate and combinations thereof.

The anionic surfactants may be primary or secondary alcohol sulphates. Linear or branched primary alcohol sulphates having 10 to 20 carbon atoms are particularly preferred. These surfactants can be obtained by sulphation of the corresponding primary or secondary alcohols, of synthetic or natural origin, followed by neutralisation. Because the acid precursors of alcohol sulphates are chemically unstable, they are not commercially available and they have to be neutralised as quickly as possible after their manufacture.

The compositions of the present invention contain from 10 to 70%, preferably from 15 to 70% by weight, of detergency builder. Preferably, the quantity of builder is in the range of from 15 to 50% by weight.

The detergent composition of the invention may contain a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5M_2O.\ Al_2O_3.\ 0.8\text{–}6SiO_2$$

where M is a monovalent cation, preferably sodium. These materials contain some bound water and are required to have a calcium ion exchange capacity of at least 50 mg CaO/g.

The preferred sodium aluminosilicates contain 1.5–3.5 $SiO_2$ units in the formula above. They can be prepared readily by reaction between sodium silicate and sodium aluminate, as amply described in the literature.

The zeolite used in the compositions of the present invention may be the commercially available zeolite A (zeolite 4A) now widely used in laundry detergent powders. However, according to a preferred embodiment of the invention, the zeolite incorporated in the compositions of the invention is maximum aluminium zeolite P (zeolite MAP) as described and claimed in EP 384 070B (Unilever), and commercially available as Doucil™ A24 from Crosfield Chemicals Ltd, UK.

Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20. especially preferred is zeolite MAP having a silicon to aluminium ratio not exceeding 1.07, more preferably about 1.00. the calcium binding capacity of zeolite MAP is generally at least 150 mg CaO per g of anhydrous material.

The detergent composition may contain crystalline or amorphous water-soluble alkali metal silicate, preferably sodium silicate having a $SiO_2$:$Na_2O$ mole ratio within the range of from 1.6:1 to 4:1, 2:1 to 3.3:1.

The water-soluble silicate may be present in an amount of from 1 to 20 wt %, preferably 3 to 15 wt % and more preferably 5 to 10 wt %, based on the total composition.

As well as the crystalline aluminosilicate builders already mentioned, other inorganic or organic builders may be present. Inorganic builders that may be present. Inorganic builders that may be present include sodium carbonate, layered silicate, amorphous aluminosilicates, and phosphate builders, for example, sodium orthophosphate, pyrophosphate and tripolyphosphate.

Organic builders that may additionally be present include polycarboxylate polymers such as polyacrylates and acrylic/maleic copolymers; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyliminodiacetates, alkyl- and alkyenylmalonates and succinates; and sulphonated fatty acid salts.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Detergent compositions according to the invention may also suitably contain a bleach system. The compositions of the invention may contain peroxy bleach compounds capable of yielding hydrogen peroxide in aqueous solution, for example inorganic or organic peroxyacids, and inorganic persalts such as the alkali metal perborates, percarbonates, perphosphates, persilicates and persulphates.

The sodium percarbonate may have a protective coating against destabilisation by moisture. Sodium percarbonate having a protective coating comprising sodium metaborate and sodium silicate is disclosed in GB 2 123 044 (Kao).

The peroxy bleach compound, for example sodium percarbonate, is suitably present in an amount of from 5 to 35 wt %, preferably from 10 to 25 wt %.

The peroxy bleach compound, for example sodium percarbonate, may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N, N, N', N'-tetracetyl ethylenediamine (TAED).

A bleach stabiliser (heavy metal sequestrant) may also be present. Suitable bleach stabilisers include ethylenediamine tetraacetate (EDTA), ethylenediamine disuccinate (EDDS), and the aminopolyphosphonates such as ethylenediamine tetramethylene phosphonate (EDTMP) and diethylenetriamine pentamethylene phosphonate (DETPMP).

The compositions of the present invention may also include a bleach catalyst, such as manganese cyclononane derivative.

The compositions of the present invention may also contain soil release polymers, for example sulphonated and unsulphonated PET/POET polymers, both end-capped and non-end-capped, and polyethylene glycol/polyvinyl alcohol graft copolymers such as Sokalan™ HP22.

The compositions of the invention may also contain dye transfer inhibiting polymers, for example, polyvinyl pyrrolidone (PVP), vinyl pyrrolidone copolymers such as PVP/PVI, polyamine-N-oxides, PVP-NO etc.

A powder structurant, for example, a fatty acid (or fatty acid soap), a sugar, an acrylate or acrylate/maleate polymer may be included in the granular components. A preferred powder structurant is fatty acid soap, suitably present in an amount of from 1 to 5 wt %.

Other materials that may be present in detergent compositions of the invention include antiredeposition agents such as cellulosic polymers; fluorescers; photobleaches; inorganic salts such as sodium sulphate; foam control agents or foam boosters as appropriate; enzymes (proteases, lipases, amylases, cellulases); dyes; coloured speckles; perfumes; and fabric conditioning compounds.

Ingredients which are normally but not exclusively postdosed, may include bleach ingredients, bleach precursor, bleach catalyst, bleach stabiliser, photobleaches, alkali metal carbonate, water-soluble crystalline or amorphous alkaline metal silicate, layered silicates, antiredeposition agents, soil release polymers, dye transfer inhibitors, fluorescers, inorganic salts, foam control agents, foam boosters, proteolytic, lipolytic, amylitic and cellulytic enzymes, dyes, speckles, perfume, fabric conditioning compounds and mixtures thereof.

It is particularly preferred to include sodium carbonate. This has the advantage that it helps to structure the granule, can act to control the pH of the detergent composition when dissolved and acts as a builder. Preferably 5–30% by weight sodium carbonate are present. Minor ingredients such as layering agents (for example zeolite, Alusil™ may be present at a level 0.1–10%.

The present invention will be further described, by way of example only, with reference to the following non-limiting Examples.

Unless stated otherwise, all quantities are parts or percentages by weight.

EXAMPLES

In the following examples, the following test method was used to determine residues in a washing apparatus.

The apparatus used comprised a Miele Novotronic washing machine W916 using the Woollens 30° C. setting without pre-wash. Standard powder doses of 87 g were used (except where noted otherwise). The powder was dosed in the machine using a dispensing device of the Lever washing ball form (UK Registered Design No. 2 031 637). This comprises a near hemispherical plastic cup with a plastic covering grid to enable filling with powder and to prevent items of clothing blocking the aperture during the wash process. The dispensing device was placed on top of the cloths in the standard washing machine.

The standard load weight was 1.5 kg. The load comprised 50 cm×50 cm pieces of fabric as set out below.

| Fabric | Nominal Weight (g) | No. of pieces |
|---|---|---|
| Black cotton poplin | 29.5 | 13 |
| Black polyester cotton | 28.4 | 13 |
| Black cotton knit | 28.1 | 13 |

-continued

| Fabric | Nominal Weight (g) | No. of pieces |
|---|---|---|
| Commercial sulphur green | 80.5 | 3 |
| Sulphur green 3 ex UMIST | 31.3 | 6 |

After washing and drying, each article was first assessed visually in terms of the presence or absence of any residue and presence or absence of individual particles, residue patches and residue films, expressed as the percentage or number of cloths affected.

All articles were assessed for bleach damage against a three point scale of low, medium and high intensity expressed as the percentage of cloths affected.

Examples 1 and 2, Comparative Example A

Zeolite-built Powders Containing Primary Alcohol Sulphate (PAS) and Nonionic Surfactant Granules and detergent base powders were prepared as follows.

Nonionic Surfactant Granule N1

A mixture of sodium sulphate, sodium carbonate and Sokalan™ CP5 (acrylic/maleic copolymer ex BASF) were spray-dried to form a porous powder with the following composition:

| Ingredients | Level (wt %) |
|---|---|
| $Na_2SO_4$ | 64.2 |
| $Na_2CO_3$ | 24.0 |
| Sokalan CP5 (ex BASF) | 9.8 |
| Water | 2.0 |

The slurry was made by successively dosing Sokalan CP5, sodium sulphate and sodium carbonate in water. The moisture content of the slurry was 55% and the temperature 90° C. The slurry was sprayed in a countercurrent spray-drying tower using an inlet temperature of 350–400° C. Nonionic surfactant was sprayed onto this spray-dried carrier in a rotating pan granulator, resulting in the following composition:

| Ingredients | N1 (wt %) |
|---|---|
| $Na_2SO_4$ | 45.8 |
| $Na_2CO_3$ | 17.1 |
| Sokalan CP5 (ex BASF) | 7.0 |
| Water | 1.4 |
| Imbentin 6.5EO (ex Kolb) | 28.6 |

Anionic Surfactant Granule A1

Primary alcohol sulphate (PAS) paste containing 70% neutralised cocoPAS and 30% water was dried in a dryer/granulator supplied by VRV SpA, Italy, as follows.

The temperature of the material fed into the drying zone was set at 60° C. and a small negative pressure was applied to the drying zone. A throughput in the flash drier of 120 kg/hr of paste was used. The temperature of the wall of the drying zone was initially 140° C. The heat transfer areas of the drying and cooling zones were 10 $m^2$ and 5 $m^2$ respectively. The temperature of the wall of the drying zone was raised in steps to 170° C. Correspondingly, the throughput was increased in steps to 430 kg/hr at 170° C. The particles then passed to a cooling zone operated at a temperature of 30° C.

This resulted in granules with the following composition.

| Ingredients | A1 (wt %) |
|---|---|
| coco PAS | 90 |
| Water | 5 |
| sodium sulphate/alkane | 5 |

Builder Granules B1 and B2

The builder granules used were commercially available:

B1: granular sodium citrate dihydrate (ex ADM)

B2: layered silicate granules (SKS-6 ex Hoechst).

Detergent Base Powder F1 (for Comparative Example A)

The following detergent powder formulation was processed using a Lödige mixer CB30, in which the various ingredients were mixed together, followed by a densification step in a Lödige mixer KM300. The process was substantially as described in EP 420 317A (Unilever).

| Ingredients | F1 (wt %) |
|---|---|
| sodium PAS | 14.2 |
| coco ethoxylate 7EO | 9.1 |
| coco ethoxylate 3EO | 6.1 |
| Zeolite MAP (anh) | 47.9 |
| Soap | 2.4 |
| Light soda ash | 2.8 |
| SCMC | 1.4 |
| Sodium citrate (dihydrate) | 7.9 |
| water etc. | 8.2 |

The PAS was introduced into the Lödige CB30 as PAS powder. This powder consisted of 45% by weight of PAS, zeolite MAP and carbonate and was prepared in a Lodige CB30 by neutralisation of PAS acid with fine sodiumcarbonate together with zeolite MAP under high shear. The PAS powder was continuously dosed into the CB30 together with the zeolite MAP, SCMC, citrate and light soda ash. A mixture of the ethoxylates and fatty acid was dosed into the Lodige CB30, as well as 50% NaOH solution, which neutralised the fatty acid. A CB30 speed of 1500 rpm was applied. The powder exiting the CB30 was layered with zeolite MAP and brought in the KM300 where it was mixed under moderate shear. Due to the temperature/moisture content of the detergent composition in the KM300, the powder composition was deformable and densification accordingly took place.

Detergent Compositions 1, 2 and A

Fully formulated detergent powder compositions were prepared, to the formulations shown in the Table below (wt % in mixture), by mixing the various ingredients described above and postdosing other ingredients as shown. The bulk density in all cases exceeded 600 g/l.

Residues scores and bleach damage scores were determined as described above and are also shown below.

The compositions of the invention showed very low patch, particle and filming scores and low bleach damage scores, particularly when compared with comparative Example A. Clearly, the compositions of the present invention show a marked improvement on the comparative example.

Examples 1 and 2, Comparative Example A
Formulations and Results

| Powder | Example 1 Invention | Example 2 Invention | Example A Comparative |
|---|---|---|---|
| Base powder F1 | | | 66.7 |
| Nonionic granules N1 | 22.2 | 22.2 | |
| PAS granules A1 | 12.4 | 12.4 | |
| Citrate granules B1 | 32.1 | | |
| SKS-6 granules B2 | | 32.1 | |
| TAED granules | 6.7 | | |
| Sodium percarbonate | 21.0 | | |
| antifoam/fluorescer granules | 4.1 | | |
| Sodium bicarbonate granules | 1.0 | | |
| Dequest 2047 | 0.4 | | |

| | Residue scores [% of articles] | | | | Bleach damage scores [% of articles] | | | |
|---|---|---|---|---|---|---|---|---|
| Ex. | Patches | Particles | Filming | Total | Low | Medium | High | Total |
| 1 | 0 | 0 | 1 | 1 | 3 | 5 | 0 | 7 |
| 2 | 0 | 2 | 5 | 7 | 3 | 5 | 0 | 7 |
| A | 3 | 37 | 33 | 43 | 8 | 14 | 3 | 25 |

Examples 3 to 5, Comparative Example B
Zeolite-built Powders with PAS and Nonionic Surfactant The following granules were used:

Nonionic Surfactant Granules N1

As described in Examples 1 and 2.

Anionic Surfactant Granules A1

As described in Examples 1 and 2.

Builder Granules B3

A slurry of zeolite MAP and Sokalan CP5 (ex BASF) was spray-dried resulting in a powder with the following composition:

| Ingredients | B3 (wt %) |
|---|---|
| Zeolite MAP | 75.6 |
| Sokalan CP5 | 18.9 |
| Water | 5.5 |

Builder Granules B4 and B5

Zeolite MAP and sodium citrate dihydrate were dosed in a high speed granulator (Fukae FS30). To this powder mixture, a 40% Sokalan CP5 (ex BASF) solution was added and granulation was continued until a product with good granulometry was obtained. The powder was dried in a fluid bed, which resulted in a powder with the following formulation (levels in wt %).

| Ingredients | Builder B4 | Builder B5 |
|---|---|---|
| Zeolite MAP (anh) | 45.4 | 56.3 |
| sodium citrate 2aq | 30.3 | 14.1 |
| Sokalan CP5 | 13.0 | 15.5 |
| water etc. | 11.3 | 14.1 |

Detergent Base Powder F2 (for Comparative Example B)

The following detergent powder formulation was processed using a Fukae FS 30 granulator. The solid ingredients (zeolite, 45% PAS granules, sodiumcitrate, SCMC, soda ash) were dosed in the mixer and premixed for 20 seconds. The ethoxylates and fatty acid were premixed in a separate vessel at a temperature of 60° C. 50% NaOH solution was added to this mixer to saponify the fatty acid, after which the mixture was quickly dosed in the granulator. Granulation was carried out using an agitator speed of 200 rpm and a chopper speed of 3000 rpm, until a satisfactory particle size was obtained.

| Ingredients | F2 (wt %) |
|---|---|
| sodium PAS | 16.11 |
| coco ethoxylate 6.5EO[1] | 5.86 |
| coco ethoxylate 3EO[1] | 7.32 |
| Zeolite MAP (anh) | 49.46 |
| Soap | 2.38 |
| Light soda ash | 3.53 |
| SCMC | 1.35 |
| Sodium citrate 2aq | 6.53 |
| water etc. | 7.45 |

The nonionic surfactants were Imbentin™ (ex Kolb).

The following fully formulated powders were prepared (amounts in parts by weight):

| Powder | 3 | 4 | 5 | B |
|---|---|---|---|---|
| Base powder F2 | | | | 56.5 |
| Nonionic granules N1 | 18.8 | 18.8 | 18.8 | |
| PAS granules A1 | 10.5 | 10.5 | 10.5 | |
| Builder granule B3 | 27.2 | | | |
| Builder granule B4 | | 27.2 | | |
| Builder granule B5 | | | 27.2 | |
| TAED granules | 5.7 | | | |
| sodium percarbonate | 17.5 | | | |
| antifoam granules | 3.5 | | | |
| Dequest 2047 | 0.35 | | | |

The bulk density in all cases exceeded 600 g/l.

The following results were obtained in the washing experiment described above.

| | Residue scores [% of articles] | | | |
|---|---|---|---|---|
| Powder | Patches | Particles | Filming | Total |
| 3 | 0 | 5.2 | 10.8 | 12.5 |
| 4 | 0 | 12.5 | 13.0 | 19.3 |
| 5 | 0 | 15.6 | 21.4 | 28.1 |
| B | 14.6 | 25.0 | 37.5 | 45.8 |

| | Bleach damage scores [% of articles] | | | |
|---|---|---|---|---|
| Powder | Low | Medium | High | Total |
| 3 | 0 | 0 | 0 | 0 |
| 4 | 0.5 | 0.5 | 0 | 1.0 |
| 5 | 0.00 | 1.6 | 0 | 1.6 |
| B | 1.0 | 2.1 | 4.2 | 8.3 |

The compositions 3, 4, 5 and B have substantially the same total surfactant level and type: however, in the Examples 3, 4 and 5 of the present invention, the builder, anionic surfactant and nonionic surfactant were substantially separated into separate particles, whereas in Comparative Example B these ingredients were together in a single base powder.

Examples 3, 4 and 5 according to the present invention showed comparatively low patch, particle and filming scores when compared to Comparative Example B.

Examples 6 and 7, Comparative Example C

Phosphate-built Powders Containing Linear Alkylbenzene Sulphonate (LAS) and Nonionic Surfactant Granules were prepared as follows:

Nonionic Surfactant Granules N2

A granule was produced using the method of Granule N1, having the following composition:

| Ingredients | N2 (wt %) |
|---|---|
| $Na_2SO_4$ | 46.7 |
| $Na_2CO_3$ | 17.5 |
| Sokalan CP5 (ex BASF) | 7.1 |
| Synperonic A7 | 14.3 |
| Synperonic A3 | 10.7 |
| water etc | 3.8 |

Anionic Surfactant Granules A2

Linear alkylbenzene sulphonate (LAS) granules were produced in a dryer/granulator from VRV SpA, Italy. LAS acid was neutralised with sodium carbonate as follows.

Sodium linear alkyl benzene sulphonate particles (NaLAS) were produced by neutralising LAS acid with sodiumcarbonate. Furthermore, zeolite MAP was dosed as a layering agent was dosed as well. A 1.2 $m^2$ VRV flash-drier machine was used having three equal jacket sections. Dosing ports for liquids and powders were situated just prior to the first hot section, with mid-jacket dosing ports available in the final two sections. Zeolite was added via this port in the final section. An electrically-powered oil heater provided the heating to the first two jacket sections. Ambient process water at 15° C. was used for cooling the jacket in the final section. Make-up air flow through the reactor was controlled between 10 and 50 $m^3$/kg hr by opening a bypass on the exhaust vapour extraction fan. All experiments were carried out with the motor at full-speed giving a tip speed of about 30 m/s. Screw-feeders were calibrated to dose sodium carbonate and zeolite MAP for layering. The sodium carbonate and liquids were added just prior to the first hot section and zeolite layering was added into the third section which was cold. The minimum level of zeolite was added to give free-flowing granules leaving the drier.

A jacket temperature of 145° C. was used in the first two sections, with an estimated throughput of components 60–100 kg/hr. A degree of neutralisation of alkyl benzene sulphonate of >95% was achieved. The bulk density, surfactant level and compressibility of the particles was then measured. They had the following composition:

| Ingredients | A2 (wt %) |
|---|---|
| sodium LAS | 90.0 |
| zeolite 4A (anh) | 9.0 |
| water etc. | 1.0 |

Builder Granules B6

Sodium tripolyphosphate (STP) powder was continuously fed into a Schugi Flexomix Granulator, whilst spraying on a 10% alkaline sodium silicate solution. The material exiting the granulator was cooled in a fluidised bed, resulting in a granular powder with the following composition:

| Ingredients | B6 (wt %) |
|---|---|
| STP | 85 |
| Sodium silicate | 2.3 |
| Water | 12.7 |

Builder Granule B7

Compacted STP, Rhodiaphos LV ex Rhône-Poulenc, was used as a builder granule.

Detergent Base Powder F3 (Comparative)

A mixture of surfactants, builder, other wash active ingredients and water was spray-dried, resulting in the following composition:

| Ingredients | F3 (wt %) |
|---|---|
| sodium LAS | 10.59 |
| Synperonic A7 | 7.06 |
| Synperonic A3 | 5.30 |
| Sokalan CP5 | 1.91 |
| STP | 40.19 |
| fatty acid/soap | 1.01 |
| sodiumsulphate | 7.42 |
| SCMC | 0.90 |
| sodiumsilicate | 10.59 |
| water etc. | 15.03 |

These granules were mixed and post-dosed to give the following formulations:

| Composition | C comparative | 6 invention | 7 invention |
|---|---|---|---|
| LAS granule A2 | | 6.7 | 6.7 |
| NI granule N2 | | 28.1 | 28.1 |
| Builder granule B6 | | 26.7 | |
| Builder granule B7 | | | 26.7 |
| Base powder F3 | 54.56 | | |
| dense sulphate | 22.47 | 11.9 | 11.9 |
| Nabion 15 (ex Rhône-Poulenc) | | 7.7 | 7.7 |
| Perborate tetrahydrate | 14.00 | 15.1 | 15.1 |
| SCMC | | 0.2 | 0.2 |
| TAED | 2.49 | 2.6 | 2.6 |
| Antifoam/fluorescer granule | 1.00 | 1.2 | 1.2 |
| Sodium carbonate | 4.10 | 0.1 | 0.1 |
| Enzymes, perfume etc. | 1.38 | 0.0 | 0.0 |
| Bulk density [g/l] | 720 | 765 | 850 |

| | Residues [% of articles] | | | | Bleach Damage [% of articles] |
|---|---|---|---|---|---|
| | Patches | Particles | Filming | Total | Low |
| C | 0 | 10.8 | 10.0 | 14.6 | 4.2 |
| 6 | 0 | 4.2 | 4.8 | 7.5 | 2.1 |
| 7 | 0 | 2.7 | 2.7 | 7.5 | 0 |

Compositions C, 6 and 7 are similar in terms of surfactant level and surfactant type. However, in compositions 6 and 7 according to the invention, the surfactant components have been separated into separate particles and have been separated from builder components. As a result, it is found that residue and bleach damage are surprisingly reduced.

Examples 8 and 9, Comparative Example D

Zeolite-built Powders Containing LAS and Nonionic Surfactant

The following granules were produced:

Nonionic surfactant granules N3

A mixture of carbonate, bicarbonate and Sokalan CP5 was spray-dried. Onto the resulting powder a mixture of alcohol ethoxylates (3EO and 7EO) was sprayed in a pan granulator, resulting in the following total formulation:

| Ingredients | N3 (wt %) |
|---|---|
| $NaHCO_3$ | 28.5 |
| $Na_2CO_3$ | 35.9 |
| Sokalan CP5 | 7.3 |
| water | 1.5 |
| Synperonic A7 (ex ICI) | 17.4 |
| Synperonic A3 (ex ICI) | 9.4 |

Anionic Surfactant Granules A3

The process of Granule A2 was repeated, using a 2 $m^2$ VRV machine, to produce granules containing 71.4% by weight LAS.

Builder Granules B4 Were as Described Above

Detergent Powder F4 (for Comparative Example D)

The following detergent powder formulation was processed using a Lödige CB30, in which the various ingredients were mixed together, followed by a densification step in a Lödige KM300.

| Ingredients | F4 (wt %) |
|---|---|
| sodium LAS | 14.6 |
| Synperonic A7 | 7.7 |
| Synperonic A3 | 4.1 |
| Zeolite MAP (anh) | 46.7 |
| fatty acid | 1.9 |
| Light soda ash | 12.4 |
| SCMC | 0.9 |
| soil release polymer | 1.6 |
| water etc. | 10.1 |

These various ingredients were assembled into the following fully formulated powders:

| Powder | 8 Invention | 9 Invention | D Comparative |
|---|---|---|---|
| Detergent powder F4 | | | 62.86 |
| Nonionic granules N3 | 26.40 | 24.45 | |
| LAS granules A3 | 12.30 | 11.40 | |
| Builder granules B4 | 13.43 | 27.80 | |
| TAED granules | 6.75 | 6.00 | 6.00 |
| Sodiumpercarbonate | 23.25 | 20.00 | 22.50 |
| antifoam/fluorescer granules | 4.00 | 4.00 | 4.00 |
| Sodium carbonate granules | 5.34 | | |
| Sodium bicarbonate granules | 1.00 | 1.00 | 1.00 |
| Nabion 15 (ex Rhône-Poulenc) | 3.00 | 2.50 | |
| Dequest 2047 | 1.00 | 1.00 | 1.34 |
| Savinase | 0.78 | 1.00 | 1.00 |
| Lipolase | 0.25 | 0.25 | 0.30 |
| Bulk density [g/l] | 730 | 755 | 850 |

The residue results (dosage in machine 70 g per wash) were as follows:

| | Residue scores [% of articles] | | | |
|---|---|---|---|---|
| Powder | Patches | Particles | Filming | Total |
| 8 | 1.0 | 10.9 | 15.6 | 19.3 |
| 9 | 1.6 | 14.1 | 19.3 | 24.5 |
| D | 4.7 | 22.9 | 28.6 | 39.1 |

The compositions 8, 9 and D have substantially the same composition in terms of active level and type. However, in Examples 8 and 9 according to the invention, the nonionic surfactant, anionic surfactant and builder components are substantially separated into separate granules. As a result, marked improvements in patch, particle and film scores can be observed.

Examples 10 and 11, Comparative Examples E, F and G

Zeolite-built Powders Containing LAS and Nonionic Surfactant

The following granules were prepared.

Builder Granule B8

A builder granule was produced by continuously dosing zeolite MAP, granular trisodium citrate and 40% Sokalan CP5 solution into a Lödige CB30 recycler. The CB30 was operated at 1500 rpm. The exiting powder was led through a Lödige KM300 ploughshare (120 rpm), in which densification took place. The resulting powder was dried in a fluid bed with an air temperature of 110° C. The composition of the resulting builder granule was:

| Ingredients [wt %] | B8 |
|---|---|
| Zeolite MAP (anh) | 41.6 |
| Trisodium citrate | 31.3 |
| Sokalan CP5 | 12.2 |
| Water etc. | 14.9 |

Nonionic Surfactant Granules N4

The nonionic surfactant granule N4 was produced using silica (Sorbosil TC15 ex Crosfield) as the carrier. It was prepared in a Fukae FS30 mixer. The following procedure was used. Silica was dosed into the Fukae and a mixture of nonionic and fatty acid, heated to approximately 60° C., was added to the solids, after which a 50% NaOH solution was sprinkled on top. Directly after addition of the NaOH, the mixture was granulated, using agitator speeds of 100–200 rpm and a chopper speed of 3000 rpm. Typical granulation time was 1 min. The resulting powder was layered with silica and removed from the granulator. The composition of nonionic granule I was the following:

| Ingredients | N4 |
|---|---|
| Sorbosil TC15 | 26.1 |
| Neodol 91-6 | 64.7 |
| Soap | 7.8 |
| Water etc. | 1.4 |

Nonionic Surfactant Granules N5

These granules were produced by first spray-drying a mixture of carbonate, bicarbonate, citrate and Sokalan CP5. The spray-dried material was dosed into a Lödige -M300 D after which nonionic was sprayed on. The Lödige was operated at a speed of 120 rpm with the choppers switched off. Spray on was carried out for 12 minutes. The final composition was as follows:

| Ingredients | N5 |
|---|---|
| Synperonic A7 | 25.4 |
| $NaHCO_3$ | 31.8 |
| $Na_2CO_3$ | 31.8 |
| Sokolan CP5 | 8.0 |
| Water, minors etc. | 3.0 |

Nonionic Surfactant Granule NX (for Comparative Example E) was made by using the spray-dried carrier as described. In this case, the spray-dried carrier was mixed with zeolite MAP, after which nonionic was mixed in and granulation was carried out in an Eirich RV02 mixer. The Eirich was operated with a stirrer speed of 400 rpm. Granulation was carried out for 10 seconds. The final composition was as follows:

| Ingredients | NX |
|---|---|
| Synperonic A7 | 26 |
| $NaHCO_3$ | 16.6 |
| $Na_2CO_3$ | 16.6 |
| Zeolite MAP (anh) | 31.5 |
| Sokolan CP5 | 4.2 |
| Water, minors etc. | 5.1 |

As can be seen the zeolite level in this nonionic granule is clearly above the maximum level of 10% specified according to the present invention.

Anionic Surfactant Granules A4 and A5

These was prepared by the method used for Granule A2. Anionic surfactant granule A4 had the following composition:

| Ingredients | A4 |
|---|---|
| NaLAS | 81.0 |
| Zeolite MAP (anh) | 10.0 |
| Carbonate | 5.0 |
| Water, NDOM etc | 4.0 |

Anionic surfactant granule A5 was made in the same manner, using a 2 $m^2$ VRV machine, but had a NaLAS content of 70 wt %, and contained 20 wt % zeolite 4A and 5 wt % zeolite MAP.

Anionic Surfactant Granule AX (for Comparative Example F) was prepared by continuously dosing LAS acid, sodium carbonate and zeolite MAP in a Lödige CB30 recycler. The product was granulated in the CB30 and cooled in the fluid bed to obtain free flowing granules. The composition of anionic surfactant granule AX was as follows:

| Ingredients [wt %] | AX |
|---|---|
| NaLAS | 47.1 |
| Zeolite MAP (anh) | 36.0 |
| Carbonate | 5.6 |
| Water, NDOM etc | 11.2 |

The NaLAS level is lower than the 60% minimum specified in accordance with the present invention.

Detergent powders were prepared by mixing to the formulations shown below. Examples 10 and 11 are in accordance with invention, Examples E, F and G are comparative. For Comparative Example G the base powder F4 was used.

| Formulation [wt %] | 10 | E | F | 11 | G |
|---|---|---|---|---|---|
| Granule B8 | 22.6 | 23.2 | 17.7 | 22.0 | |
| Granule N4 | | | | 10.8 | |
| Granule N5 | 27.5 | | 27.5 | | |
| Granule NX | | 26.9 | | | |
| Granule A4 | | | | 10.7 | |
| Granule A5 | 12.4 | 12.4 | | | |
| Granule AX | | | 17.3 | | |
| Base powder F4 | | | | | 61.0 |
| Percarbonate | 19 | 19 | 19 | 19 | 19 |
| TAED | 5.5 | 5.5 | 5.5 | 5.5 | 5.5 |
| EAG adjunct | 1.7 | 1.7 | 1.7 | 1.7 | 1.7 |
| SCMC | 0.5 | 0.5 | 0.5 | 0.5 | |
| Fluorescer adjunct | 1.3 | 1.3 | 1.3 | 1.3 | 1.3 |
| PVP | 0.1 | 0.1 | 0.1 | 0.1 | 0.1 |
| Soil release polymer granule | 1.5 | 1.5 | 1.5 | 1.5 | 1.5 |
| Sokolan CP5 granules | | | | | 1.0 |
| Nabion 15 | 5.5 | 5.5 | 5.5 | 5.5 | 5.5 |
| Dense carbonate | 0.5 | 0.5 | 0.5 | 19.5 | 0.5 |
| Sodiumbicarbonate | | | | | 1.0 |
| Dequest 2047 | 1 | 1 | 1 | 1 | 1 |
| Savinase 12.0T | 0.78 | 0.78 | 0.78 | 0.78 | 0.78 |
| Lipolase 100 T | 0.12 | 0.12 | 0.12 | 0.12 | 0.12 |
| BD [g/l] | 843 | 852 | 799 | 694 | 893 |

The residue scores are shown below. Clearly the invention products performed better than the comparative examples.

| Product | Dye damage scores (total) [% of cloths] | Residue scores (total) [% of cloths] |
|---|---|---|
| 10 (Invention) | 2.1 | 28.6 |
| E (Comparative) | 4.7 | 43.2 |
| F (Comparative) | 5.7 | 32.8 |
| 11 (Invention) | 0.7 | 14.5 |
| G (Comparative) | 5.7 | 50.0 |

If the zeolite level in the nonionic granule is too high, a high level of residues and dye damage is observed (Comparative Example E).

Similarly if the active level in the anionic granule is too low, the dye damage will be high (Comparative Example F).

Examples 12 and 13

Builder granules B8, nonionic surfactant granules N5 and anionic surfactant granules A1 and A5 were as described in Examples 10 and 11.

Nonionic Surfactant Granule N6 was prepared by a process route consisting of a Lödige CB30, followed by a Niro fluid bed and a Mogensen sieve. The Lödige CB30 was operated at 1500 rpm. Water was used to cool the CB30 jacket during the process. The air flow in the Niro fluid bed was 900–1000 $m^3$/hr. The total flow of powder exiting the process was in the order of 600 kg/h.

Silica (Sorbosil™ TC15 ex Crosfield) was continously dosed into the CB30, into which also a mixture of nonionic surfactant (Lutensol A07 ex BASF) and fatty acid (Pristerene 4916 ex Unichema) was dosed via dosing pipes. At the same time 50% NaOH was dosed to neutralise the fatty acid. This set of solid and liquid materials was mixed and granulated in the CB30 after which the resulting powder was entered in the fluid bed and cooled with ambient air. Fines were filtered from the air stream with a cyclone and filter bags. Coarse particles (>1400 $\mu$m) were separated from the product by the Mogensen sieve.

| Composition [wt %] | N6 |
|---|---|
| Sorbosil TC15 | 30.0 |
| Lutensol AO7 | 55.0 |
| Soap | 13.1 |
| Water | 1.9 |

These granules were mixed with other postdose materials to make products according to the invention:

| Formulation | 12 | 13 |
|---|---|---|
| Builder granule B8 | | 10 |
| LAS granule A5 | 26 | |
| PAS granule A1 | | 17.8 |
| Nonionic granule N5 | 38.6 | |
| Nonionic granule N6 | | 29 |
| Granular citrate | | 7.6 |
| Dense carbonate | 1.8 | 2 |
| Percarbonate | 19.00 | 19.00 |
| TAED | 5 | 5 |
| EAG adjunct | 1.7 | 1.7 |
| SCMC | 0.6 | 0.6 |
| Fluorescer adjunct | 1.3 | 1.3 |
| Nabion 15 | 5 | 5 |
| Dequest 2047 | 1 | 1 |
| Total surfactant [%] | 28.0 | 35.9 |
| BD [g/l] | 750 | 682 |
| DFR [ml/s] | 118 | 134 |

We claim:

1. A particulate detergent composition or component having a bulk density of at least 600 g/l and comprising at least 10% by weight of organic detergent surfactant and from 10 to 70% by weight of detergency builder, the composition comprising at least two different granular components:

(i) granules comprising at least 60% by weight of anionic surfactant, and (ii) granules comprising at least 20% by weight of nonionic surfactant, less than 10% by weight of aluminosilicate and less than 10% by weight of anionic surfactant.

2. A detergent composition or component as claimed in claim 1, containing from 1 to 50% by weight of the nonionic surfactant granules (ii).

3. A detergent composition or component as claimed in claim 2, which contains from 1 to 30% by weight of the nonionic surfactant granules (ii).

4. A detergent composition or component as claimed in claim 1, which contains from 1 to 70% by weight of the anionic surfactant granules (i).

5. A detergent composition or component as claimed in claim 1, which further comprises granules (iii) comprising up to 100% by weight of detergency builder and optionally from 0 to 10% by weight of anionic and/or nonionic surfactant.

6. A detergent composition or component as claimed in claim 5, wherein the builder granules (iii) comprise up to 90% by weight of builder and optionally from 0 to 10% by weight of anionic and/or nonionic surfactant.

7. A detergent composition or component as claimed in claim 5, which comprises from 5 to 80% by weight of the builder granules (iii).

8. A detergent composition or component as claimed in claim 1, which comprises from 15 to 70 wt % of builder.

9. A detergent composition or component as claimed in claim 1, wherein the builder is alkali metal aluminosilicate.

10. A detergent composition or component as claimed in claim 1, wherein the granules (i) comprising at least 60% by weight of anionic surfactant optionally comprise from 0 to 40% by weight of detergency builder.

11. A detergent composition or component as claimed in claim 1, wherein the granules (i) containing at least 60% by weight of anionic surfactant comprise less than 15% by weight of aluminosilicate builder.

12. A detergent composition or component as claimed in claim 1, wherein the granules (ii) containing at least 20% by weight of nonionic surfactant comprise nonionic surfactant carried on water-soluble carrier material, the nonionic surfactant being present at a level of 20 to 50% by weight based on the granules (ii).

13. A detergent composition or component as claimed in claim 1, wherein the granules (ii) containing at least 20% by weight of nonionic surfactant comprise nonionic surfactant carried on a water-insoluble carrier material selected from the group consisting of silicas, aluminosilicates and mixtures thereof.

14. A detergent composition or component as claimed in claim 1, wherein the total quantity of detergent surfactant in the composition is at least 12% by weight.

15. A detergent composition or component as claimed in claim 1, which comprises from 1 to 40% by weight of nonionic surfactant.

16. A particulate detergent composition or component having a bulk density of at least 600 g/l and comprising at least 10% by weight surfactant and from 15 to 70% by weight of builder, the composition or component being composed of at least three different granular components:

(i) granules comprising at least 60% by weight of anionic surfactant, (ii) from 1 to 30% by weight of granules comprising at least 20% by weight of nonionic surfactant, and less than 10% by weight of aluminosilicate, (iii) granules comprising up to 90% by weight of builder and from 0 to 10% by weight of anionic or nonionic surfactant.

17. A method of manufacturing a detergent powder composition or component as claimed in claim 1, comprising the steps of:

(i) manufacturing granules comprising at least 60% by weight of anionic surfactant, (ii) manufacturing granules containing at least 20% by weight nonionic surfactant less than 10% by weight aluminosilicate, and less than 10% by weight of anionic surfactant, (iii) optionally manufacturing granules comprising up to 100% by weight of builder and optionally from 0 to 10% by weight of nonionic or anionic surfactant, and mixing the granules produced in steps (I) and (ii), and optionally the granules produced in step (iii).

* * * * *